US006468073B1

(12) United States Patent
Weidman

(10) Patent No.: US 6,468,073 B1
(45) Date of Patent: Oct. 22, 2002

(54) DUCT BURNER DIFFUSER

(75) Inventor: George H. Weidman, Carrollton, TX (US)

(73) Assignee: Forney Corporation, Carrollton, TX (US)

( * ) Notice: Subject to any disclaimer, the term of this patent is extended or adjusted under 35 U.S.C. 154(b) by 0 days.

(21) Appl. No.: 09/879,518

(22) Filed: Jun. 12, 2001

(51) Int. Cl.[7] ..... F24H 1/00

(52) U.S. Cl. ..... 431/350; 431/351; 431/354; 432/222

(58) Field of Search ..... 431/350, 351, 431/354, 202, 347, 5, 171, 356; 60/749; 432/222, 29; 126/110 R

(56) References Cited

U.S. PATENT DOCUMENTS 3,044,754 A * 7/1962 Skerkoske et al. ..... 432/222
4,737,100 A * 4/1988 Schnell et al. ..... 431/350
4,767,319 A * 8/1988 Vosper ..... 431/350
5,820,365 A * 10/1998 Oppenberg et al. ..... 432/222
6,301,875 B1 * 10/2001 Backlund ..... 60/749

FOREIGN PATENT DOCUMENTS

JP 89611 * 5/1985 ..... 431/354

OTHER PUBLICATIONS

Drawing No. 395452–02, Rev. A Forney Corporation, Copyright 1998.
Drawing No. 389545–01, Rev. B Forney Corporation, Copyright 1995.

* cited by examiner

*Primary Examiner*—James C. Yeung
(74) *Attorney, Agent, or Firm*—Locke Liddell & Sapp LLP

(57) ABSTRACT

A diffuser for a gas duct burner having a fuel pipe and a plurality of stabilizers includes a plate having first and second spaced apart ends defining a length, and first and second spaced apart sides defining a width. The plate has a first portion having a uniform width which is disposed adjacent to the stabilizer and a second portion having a variable width.

17 Claims, 3 Drawing Sheets

DUCT BURNER DIFFUSER

TECHNICAL FIELD OF THE INVENTION

The present invention relates to combustion equipment and more particularly to an improved diffuser for a gas duct burner.

BACKGROUND OF THE INVENTION

In order to increase combustion in a duct burner downstream of a gas turbine, it is desirable to increase the mixing rate of the fuel and turbine exhaust gas (TEG) in order to stabilize the flame and create a low velocity zone. Enhanced combustion results in a decrease in the amount of carbon monoxide generation. Techniques have been utilized for improving combustion and lowering carbon monoxide generation through the use of stabilizers and diffusers. Stabilizers entrain fuel within an ignition zone, and diffusers create an obstruction in the flow stream to create a wake flow. However, enhanced downstream mixing rates and lower carbon monoxide generation is not sufficiently achieved by present designs.

A need has thus arisen for an improved diffuser for the generation of smaller and out of plane vortices to enhance the downstream mixing of fuel and TEG which also reduces carbon monoxide generation.

SUMMARY OF THE INVENTION

In accordance with the present invention, a diffuser for a gas duct burner having a fuel pipe and a plurality of stabilizers is provided. The diffuser includes a plate having first and second spaced apart ends defining a length, and first and second spaced apart sides defining a width. The plate has a first portion having a uniform width which is disposed adjacent to a stabilizer and a second portion having a variable width.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
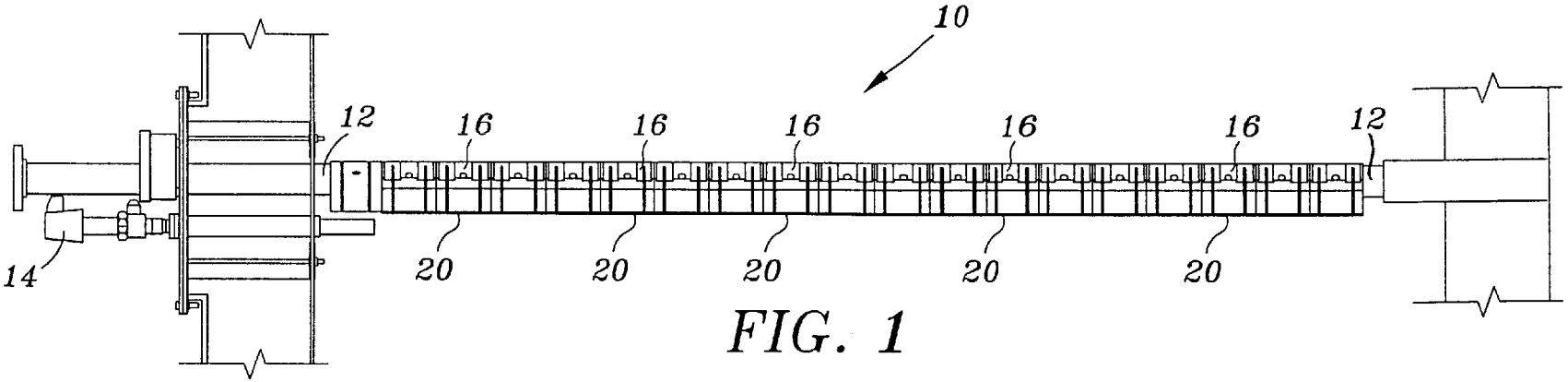
FIG. 1 is a top plan view of duct burner illustrating the present diffuser.
Figure 2:
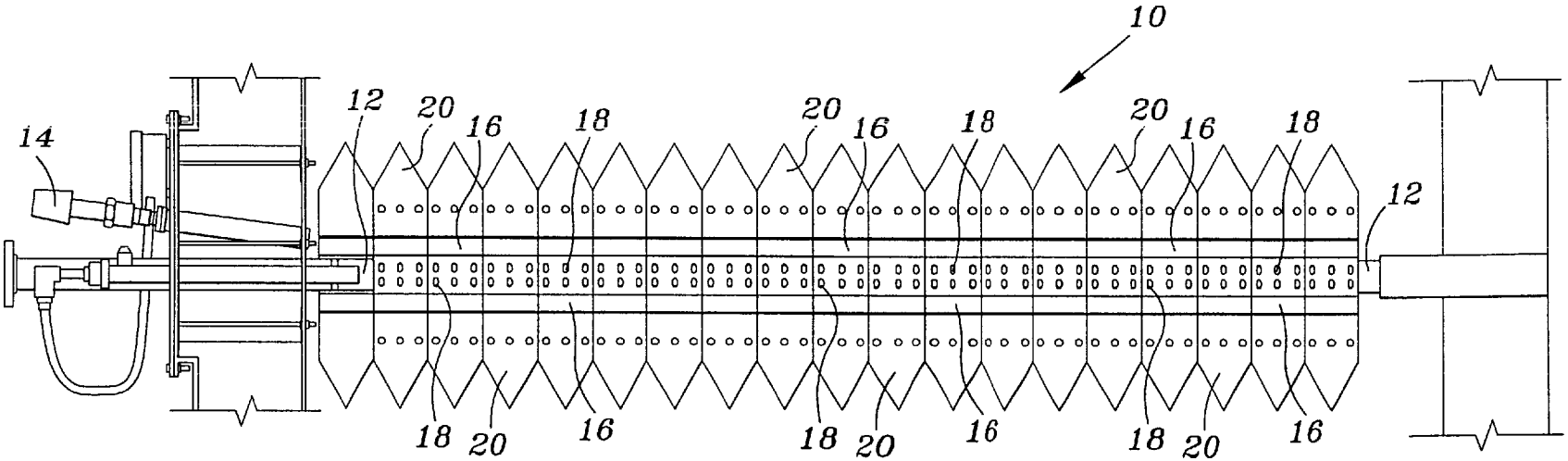
FIG. 2 is a side elevational view of the duct burner illustrated in FIG. 1 showing the present diffuser.

Referring simultaneously to FIGS. 1 and 2, a duct burner used with the present diffuser is illustrated, and is generally identified by the numeral 10. Multiple duct burners 10 may be utililized in a combustion system, and are disposed downstream of a gas turbine generator producing a TEG stream and upstream of a steam generator. Duct burner 10 includes a fuel pipe 12 which receives fuel from a source (not shown) under control of control devices 14. Disposed along fuel pipe 12 are multiple stabilizers 16. Stabilizers 16 include a plurality of apertures 18 which are aligned with apertures (not shown) within fuel pipe 12 for allowing fuel to exit from fuel pipe 12 in the region surrounded by stabilizers 16. Stabilizers 16 function to promote complete combustion of the gas exiting from fuel pipe 12.

Figure 3:
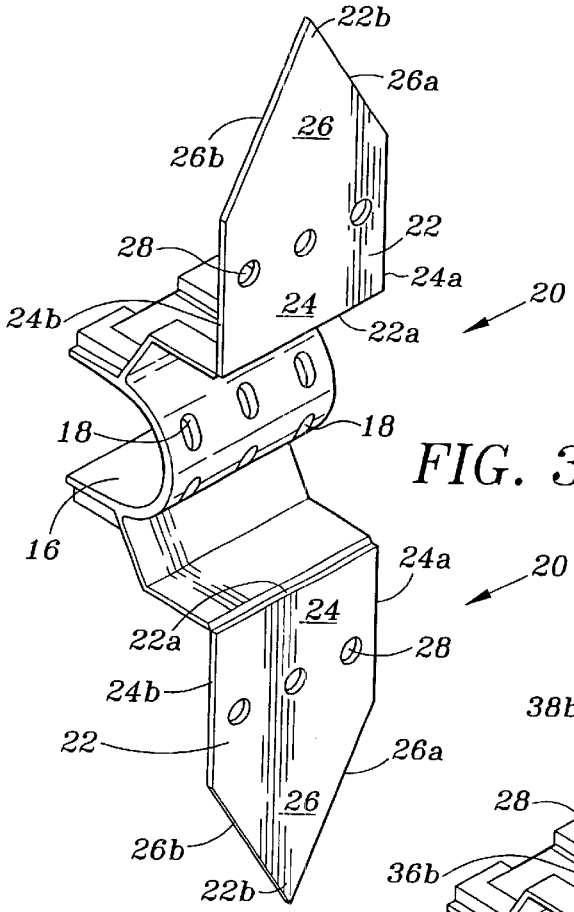
FIG. 3 is a perspective view of a stabilizer shown in FIG. 2 illustrating the present diffuser.

Referring now to FIGS. 2 and 3, an important aspect of the present invention is the use of diffusers 20. Diffusers 20 extend outwardly from stabilizers 16 on both sides of fuel pipe 12. Diffusers 20 in combination with stabilizers 16 function to mix gas and the TEG stream in order to stabilize the flame. Diffusers 20 generate smaller and out of plane vortices to enhance the downstream mixing as well as lower carbon monoxide generation. Increased vortex generation occurs between adjacent diffusers 20 to increase eddy flow in a plane orthogonal to the plane where mixing occurs caused by stabilizers 16. Diffusers 20 increase the shielding of the initial combustion zone downstream from the TEG stream and increase the downstream mixing rate due to the out of plane vortices produced by the shape of diffusers 20 thereby lowering carbon monoxide generation.

Referring to FIG. 3, diffuser 20 includes a plate 22. Plate 22 includes a first portion 24 and a second portion 26. First portion 24 is attached to stabilizer 16 and has a uniform width between spaced apart sides 24*a* and 24*b*. Second portion 26 of diffuser 20 has a variable width extending between spaced apart sides 26*a* and 26*b*. Plate 22 has an overall length extending between ends 22*a* and 22*b*. It therefore can be seen that the width of plate 22 changes between ends 22*a* to end 22*b* from a uniform width to a variable width. FIG. 3 illustrates diffuser 20 having a triangular shaped second portion 26. Second portion 26 is generally configured as an equilateral triangle. First portion 24 and second portion 26 of plate 22 may be continuous in construction, and, alternatively, two separate portions 24 and 26 may be interconnected together to form plate 22. Portion 24 of plate 22 includes a plurality of apertures 28 for increasing vortex flow.

Figure 4:
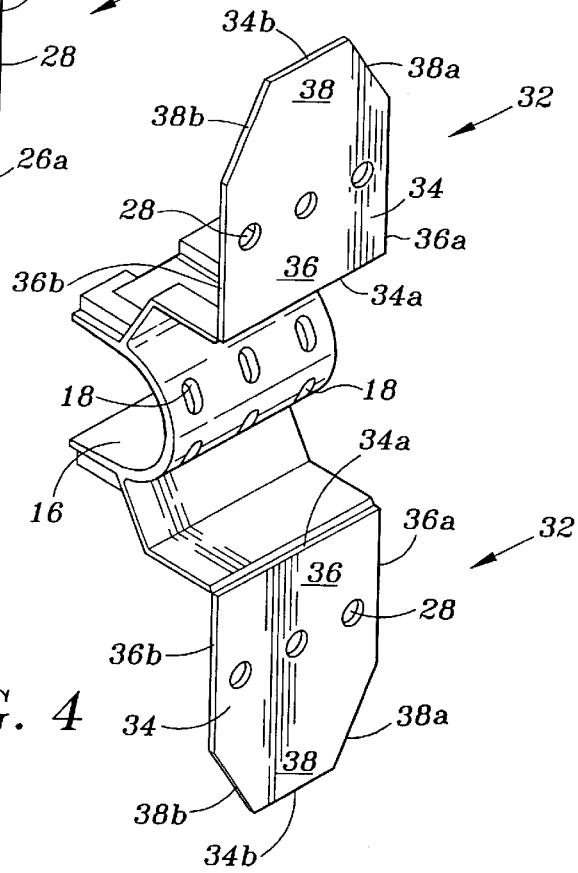
FIGS. 4–6 illustrate the stabilizer of FIG. 2 and further embodiments of the present diffuser.

Referring now to FIG. 4, stabilizer 16 is illustrated together with a further embodiment of the present diffuser, generally identified by the numeral 32. Diffuser 32 includes a plate 34 having a first portion 36 and a second portion 38. First portion 36 of plate 34 has a uniform width extending between sides 36*a* and 36*b*. Second portion 38 of plate 34 includes a variable width extending between sides 38*a* and 38*b*. Second portion 38 of plate 34 is similar in configuration to second portion 26 of plate 22 (FIG. 3), but has a truncated triangular configuration. Diffuser 32 decreases in width from end 34*a* to end 34*b*. First portion 36 and second portion 38 of plate 34 may be fabricated from a continuous sheet of material or separately fabricated and subsequently interconnected.

Figure 5:
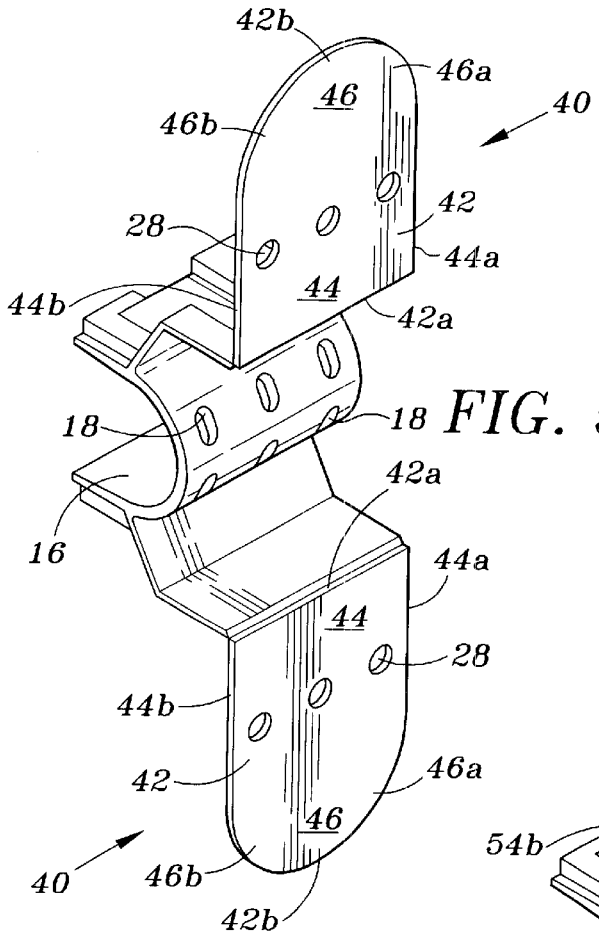

Referring now to FIG. 5, a further embodiment of the present diffuser is illustrated, and is generally identified by the numeral 40. Diffuser 40 includes a plate 42 having a general arcuate configuration. Plate 40 includes a first portion 44 and a second portion 42. First portion 44 has a uniform width extending between sides 44*a* and 44*b*. Second portion 46 of plate 42 has a variable width extending between sides 46*a* and 46*b*. The overall length of plate 42 extending between ends 42*a* and 42*b* has a variable width. End 42*b* of plate 42 has an arcuate configuration.

First portion 44 and second portion 46 of plate 42 may be fabricated from a continuous sheet of material or separately fabricated and subsequently interconnected.

Figure 6:
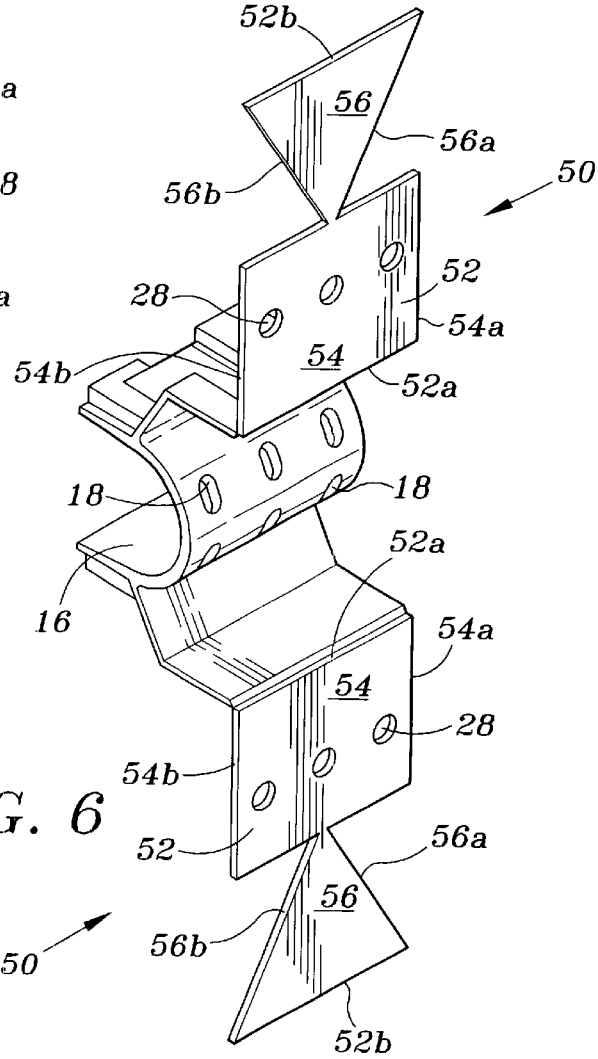

Referring now to FIG. 6, a further embodiment of the present diffuser is illustrated, and is generally identified by the numeral 50. Diffuser 50 includes a plate 52 having a first portion 54 and a second portion 56. First portion 54 has a uniform width extending between sides 54*a* and 54*b*. Second portion 56 has a variable width extending between side 56*a* and 56*b*. The width of second portion 56 increases in a direction outwardly of stabilizer 16. The overall length of plate 52 extending between ends 52*a* and 52*b* is variable. Second portion 56 of plate 52 is configured in an inverted position from second portion 26 of plate 22 of diffuser 20 (FIG. 3), and comprises an equilateral triangle having a base spaced apart from first portion 54 of plate 52.

As can be seen, diffusers 20, 32, 40, and 50 each have a portion of uniform width and a portion of variable width extending over the length of the diffuser. The portion of variable width creates an additional vortex to enhance downstream mixing, increase the shielding of the initial combustion zone from the TEG stream which results in lower carbon monoxide generation.

It therefore can be seen that the present invention provides for an improved diffuser which generates out of plane vortices to enhance downstream mixing in a duct burner. The present diffuser provides increased shielding, and coupled with the out of plane vortex generation, results in lower carbon monoxide generation.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A diffuser for a gas duct burner having a fuel pipe and a stabilizer, the fuel pipe having a longitudinal axis, the diffuser comprising:

a plate having first and second spaced apart ends defining a length and first and second spaced apart sides defining a width;

said plate having a first portion adapted to be disposed adjacent to the stabilizer and having a uniform width; and said plate having a second portion having a variable width extending along said plate length, said plate second portion creating a vortex flow having an axis of rotation generally perpendicular to the pipe axis.

2. The diffuser of claim 1 wherein said width of said second portion decreases from said first portion of said plate to said second end of said plate.

3. The diffuser of claim 1 wherein said width of said second portion increases from said plate first portion to said second end of said plate.

4. The diffuser of claim 1 wherein said second portion of said plate has a triangular shape.

5. The diffuser of claim 1 wherein said second portion of said plate has a semicircular shape.

6. A diffuser for a gas burner having a fuel pipe and a stabilizer, the fuel pipe having a longitudinal axis, the diffuser comprising:

a first member having a first end adapted to be disposed adjacent to the stabilizer, said first member having a second end spaced apart from said first end, and first and second sides extending between said first and second ends, said first and second sides being spaced apart by a uniform distance; and a second member having a first end disposed adjacent to said second end of said first member and a second end spaced apart from said first end, and first and second sides extending between said first and second ends and being spaced apart by a variable distance between said first and second ends said members creating a vortex flow having an axis of rotation generally perpendicular to the pipe axis.

7. The diffuser of claim 6 wherein the distance between said first and second sides of said second member decreases from said first end to said second end thereof.

8. The diffuser of claim 6 wherein the distance between said first and second sides of said second member increases from said first end to said second end thereof.

9. The diffuser of claim 6 wherein said second member has a shape of an equilateral triangle.

10. The diffuser of claim 6 wherein said second member has a shape of a truncated triangle.

11. The diffuser of claim 6 wherein said second member has a shape of a semicircle.

12. A gas duct burner comprising:

a fuel pipe having an axis;

a plurality of stabilizers disposed along said fuel pipe, each of said stabilizers creating a vortex flow having an axis of rotation generally parallel to said fuel pipe axis;

a plurality of diffusers, one of said plurality of diffusers being disposed adjacent to one of said plurality of stabilizers, each of said diffusers creating a vortex flow having an axis of rotation generally perpendicular to said fuel pipe axis;

said diffusers each including a plate having first and second spaced apart ends defining a length and first and second spaced apart sides defining a width;

said plate having a first portion disposed adjacent to said stabilizer and having a uniform width; and said plate having a second portion having a variable width extending along said plate length.

13. The diffuser of claim 12 wherein said width of said second portion decreases from said first portion of said plate to said second end of said plate.

14. The diffuser of claim 12 wherein said width of said second portion increases from said plate first portion to said second end of said plate.

15. The diffuser of claim 12 wherein said second portion of said plate has a triangular shape.

16. The diffuser of claim 12 wherein said second portion of said plate has a semicircular shape.

17. A method for fuel mixing in a gas duct burner having a fuel pipe, the fuel pipe having an axis, a plurality of stabilizers disposed along the fuel pipe and a plurality of diffusers disposed adjacent to the plurality of stabilizers comprising:

creating a vortex flow axis of rotation between adjacent ones of the plurality of diffusers in a plane generally perpendicular to a plane containing a vortex flow axis of rotation created by the stabilizers, the plane containing the vortex flow axis of rotation created by the stabilizers being generally parallel to the fuel pipe axis.

* * * * *